US008327672B2

(12) United States Patent
Hill

(10) Patent No.: US 8,327,672 B2
(45) Date of Patent: Dec. 11, 2012

(54) METHODS AND SYSTEMS FOR WATER DELIVERY IN AN ADDITIVE DISPENSER

(75) Inventor: Chris H. Hill, Ames, IA (US)

(73) Assignee: Electrolux Home Products, Inc., Charlotte, NC (US)

( * ) Notice: Subject to any disclaimer, the term of this patent is extended or adjusted under 35 U.S.C. 154(b) by 602 days.

(21) Appl. No.: 11/962,335

(22) Filed: Dec. 21, 2007

(65) Prior Publication Data

US 2009/0158782 A1 Jun. 25, 2009

(51) Int. Cl.
*D06F 29/00* (2006.01)
*D06F 35/00* (2006.01)

(52) U.S. Cl. ..... 68/17 R

(58) Field of Classification Search ..... None
See application file for complete search history.

(56) References Cited

U.S. PATENT DOCUMENTS

| | | | | |
|---|---|---|---|---|
| 3,088,305 | A | 5/1963 | Ohmann | |
| 3,124,271 | A | 3/1964 | Beck et al. | |
| 3,757,543 | A | 9/1973 | Braga | |
| 5,253,494 | A | 10/1993 | Frucco et al. | |
| 6,463,766 | B2 | 10/2002 | Kubota et al. | |
| 6,826,933 | B2 | 12/2004 | Merkle et al. | |
| 7,093,467 | B2 | 8/2006 | Kim et al. | |
| 2004/0011089 | A1 | 1/2004 | Rizzeto et al. | |
| 2004/0103696 | A1 | 6/2004 | Kim et al. | |
| 2004/0172770 | A1* | 9/2004 | Heo et al. | 8/158 |
| 2005/0155633 | A1 | 7/2005 | Daume et al. | |
| 2005/0166645 | A1 | 8/2005 | Favret | |
| 2005/0188729 | A1 | 9/2005 | Zsambeki et al. | |
| 2005/0188730 | A1 | 9/2005 | Zsambeki | |
| 2005/0210927 | A1 | 9/2005 | Kim et al. | |
| 2005/0224098 | A1 | 10/2005 | Fujii et al. | |
| 2005/0229645 | A1 | 10/2005 | Kim et al. | |
| 2005/0229652 | A1 | 10/2005 | Kim et al. | |
| 2005/0235703 | A1 | 10/2005 | Cho | |
| 2005/0235704 | A1 | 10/2005 | Cho et al. | |
| 2005/0241072 | A1* | 11/2005 | Kim et al. | 8/158 |
| 2005/0241347 | A1* | 11/2005 | Cho et al. | 68/243 |
| 2005/0252251 | A1 | 11/2005 | Rizzetto | |
| 2005/0262881 | A1 | 12/2005 | Rizzetto | |
| 2005/0274156 | A1 | 12/2005 | Yang | |
| 2005/0284193 | A1* | 12/2005 | Lyu | 68/17 R |

(Continued)

FOREIGN PATENT DOCUMENTS

| | | |
|---|---|---|
| CN | 1715521 | 1/2006 |

(Continued)

*Primary Examiner* — Michael Barr
*Assistant Examiner* — Jason Ko
(74) *Attorney, Agent, or Firm* — Banner & Witcoff, Ltd

(57) ABSTRACT

A washing apparatus such as an automatic laundry washing machine includes a wash agent dispenser drawer including an additive compartment for storing various additives such as detergent, bleach and fabric softener. One or more water inflow tubes may extend downwardly into the additive compartment and may be configured to deliver water for diluting the additives contained in the compartment. The inflow tubes are of sufficient length to reach a sub-surface portion of additive held in the compartment. Water may simultaneously be delivered to the surface of the additive. Furthermore, inflow tubes have their outlets positioned adjacent to the base(s) of one or more siphon post/cap assemblies located in the additive compartments, such that a churning effect is produced from the injection of water through the tubes and the siphoning action of the siphon post, whereby mixing is enhanced and additive buildup may be avoided and/or removed.

14 Claims, 12 Drawing Sheets

U.S. PATENT DOCUMENTS

| | | | |
|---|---|---|---|
| 2006/0144424 | A1 | 7/2006 | Marchitto et al. |
| 2007/0056328 | A1 | 3/2007 | Song |
| 2007/0056329 | A1 | 3/2007 | Song |
| 2007/0056330 | A1 | 3/2007 | Song |
| 2007/0079637 | A1 | 4/2007 | Song |

FOREIGN PATENT DOCUMENTS

| | | |
|---|---|---|
| CN | 1715522 | 1/2006 |
| DE | 3637815 | 6/1987 |
| EP | 0318070 | 5/1989 |
| EP | 0331920 | 9/1989 |
| EP | 1449952 | 8/2004 |
| FR | 2530687 | 1/1984 |
| FR | 2632984 | 12/1989 |
| GB | 2141487 | 12/1984 |
| GB | 2187764 | 9/1987 |
| JP | 63171592 | 7/1988 |
| JP | 63270098 | 11/1988 |
| JP | 2174898 | 7/1990 |
| JP | 3215296 | 9/1991 |
| JP | 10127982 | 5/1998 |
| JP | 11347291 | 12/1999 |
| JP | 2000342894 | 12/2000 |
| KR | 2005022626 | 3/2005 |
| KR | 2005036537 | 4/2005 |
| KR | 2006100617 | 9/2007 |
| KR | 2003009847 | 1/2008 |

* cited by examiner

METHODS AND SYSTEMS FOR WATER DELIVERY IN AN ADDITIVE DISPENSER

BACKGROUND

Automated washing machines (such as laundry washing machines) often include mechanisms for dispensing additives into a washing chamber (e.g., a drum of a laundry washing machine). Some dispensers contain receptacles or chambers for different additives, which can include detergents, whiteners, fabric softeners, scents, rinse aids, etc. Typically, a user fills a dispenser chamber with one or more additives. During a wash cycle, water is then automatically introduced into the dispenser chamber and mixes with the additive. The water/additive mixture then flows into a separate washing chamber. In some instances, additives may not sufficiently mix with the inflow of water since the inflow of water is generally only from above. In particular, additives in a bottom layer of a compartment or drawer might not be sufficiently diluted causing residue (e.g., additive buildup) to be left in the drawer or compartment at the end of a wash cycle.

BRIEF SUMMARY OF SELECTED INVENTIVE ASPECTS

Aspects of the invention provide a system and method for diluting additives in an efficient and tidy manner. In addition to delivering water for diluting additives through a top region of an additive drawer or compartment cover, one or more water inflow tubes are used to inject water into a region of additives residing below the surface. The water inflow tubes may be attached to or integrally formed with the additive drawer or compartment cover. Water delivered from above the cover is, in part, collected in and delivered through the water inflow tubes while water is also delivered through one or more openings in the cover to the surface of an additive in the drawer or compartment. The dual injection of water provides a more even dilution of the additives in the drawer and prevents additive buildup or residue remaining in a drawer or compartment once a wash cycle is completed. Water inflow tubes may be positioned within a predefined proximity of siphon posts and siphon caps to improve the siphoning effect and to prevent unwanted residue buildup in the vicinity of the base of the siphon post and cap.

This summary is provided to introduce a selection of concepts of the inventive subject matter that are further described below in the detailed description. This summary is not intended to identify essential features or advantages of the claimed subject matter, nor is it intended to be used to limit the scope of the claimed subject matter. Additional features and advantages of various embodiments are further described below.

BRIEF DESCRIPTION OF THE DRAWINGS

Aspects of the invention are illustrated by way of example and not by limitation in the accompanying figures in which like reference numerals indicate similar elements and in which.

DETAILED DESCRIPTION OF EXEMPLARY EMBODIMENTS

Although various embodiments are described herein using a front-loading clothes washing (or laundry) machine as an example, the invention is not limited to front loading washers. In other embodiments, additive dispensers similar to those described herein are incorporated into top loading washing machines. The invention is not limited to laundry equipment. Additive dispensers similar to those described herein can also be used in automated dishwashing equipment, as well as in other devices. Indeed, dispensers such as those described herein can be used in devices that perform no washing function.

Figure 1:
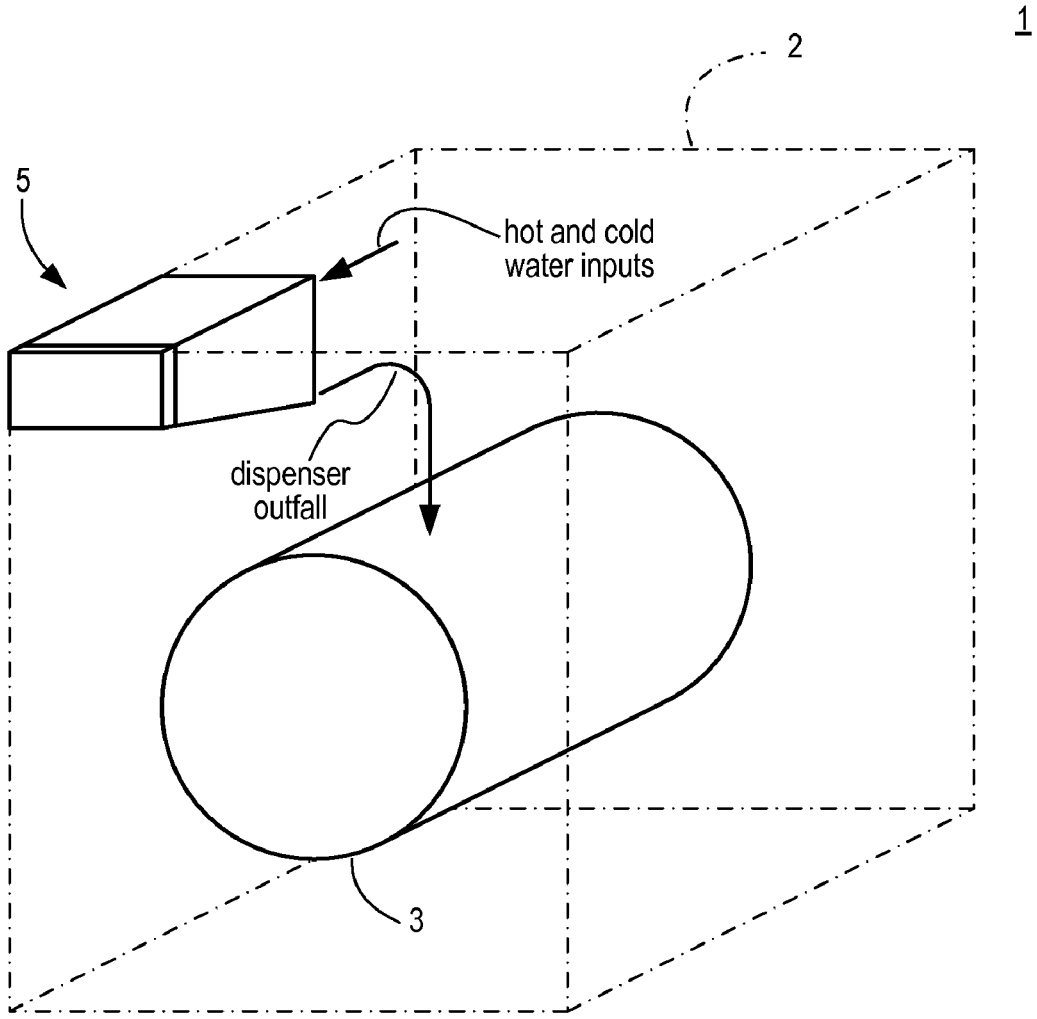
FIG. 1 is a partially schematic front perspective view of a washing machine according to some embodiments.

FIG. 1 is a partially schematic front perspective view of a clothes washing machine 1 according to at least some embodiments. The housing 2 of washing machine 1 is shown with uneven broken lines, and numerous details of washing machine 1 have been omitted so as not to obscure this description with unnecessary details. As seen in FIG. 1, washing machine 1 is of the front-loading type. Clothes or other items to be laundered are placed into a drum 3. Drum 3 is then rotated during various portions of a wash cycle by a motor (not shown). In the embodiment of FIG. 1, hot and cold water inputs are fed to a dispenser 5. The outfall from dispenser 5 then flows into drum 3. Within dispenser 5, one or more electrically-controlled valves and/or flow channels are used to direct water into drum 3. During some parts of the cycle, water bypasses various additive chambers within dispenser 5, and the outfall from dispenser 5 is water alone. During other parts of a wash cycle, and as described in more detail below, water flows through one or more chambers within dispenser 5 and mixes with additives in those chambers. As a result of said mixing, the outfall from dispenser 5 is a combination of water and one or more of the additives. The outfall may be facilitated by one or more hoses, valves and/or nozzles connecting dispenser 5 and drum 3. During (or at the conclusion of) each wash cycle, water is drained from drum 3 via a drain line (not shown).

Figure 2:
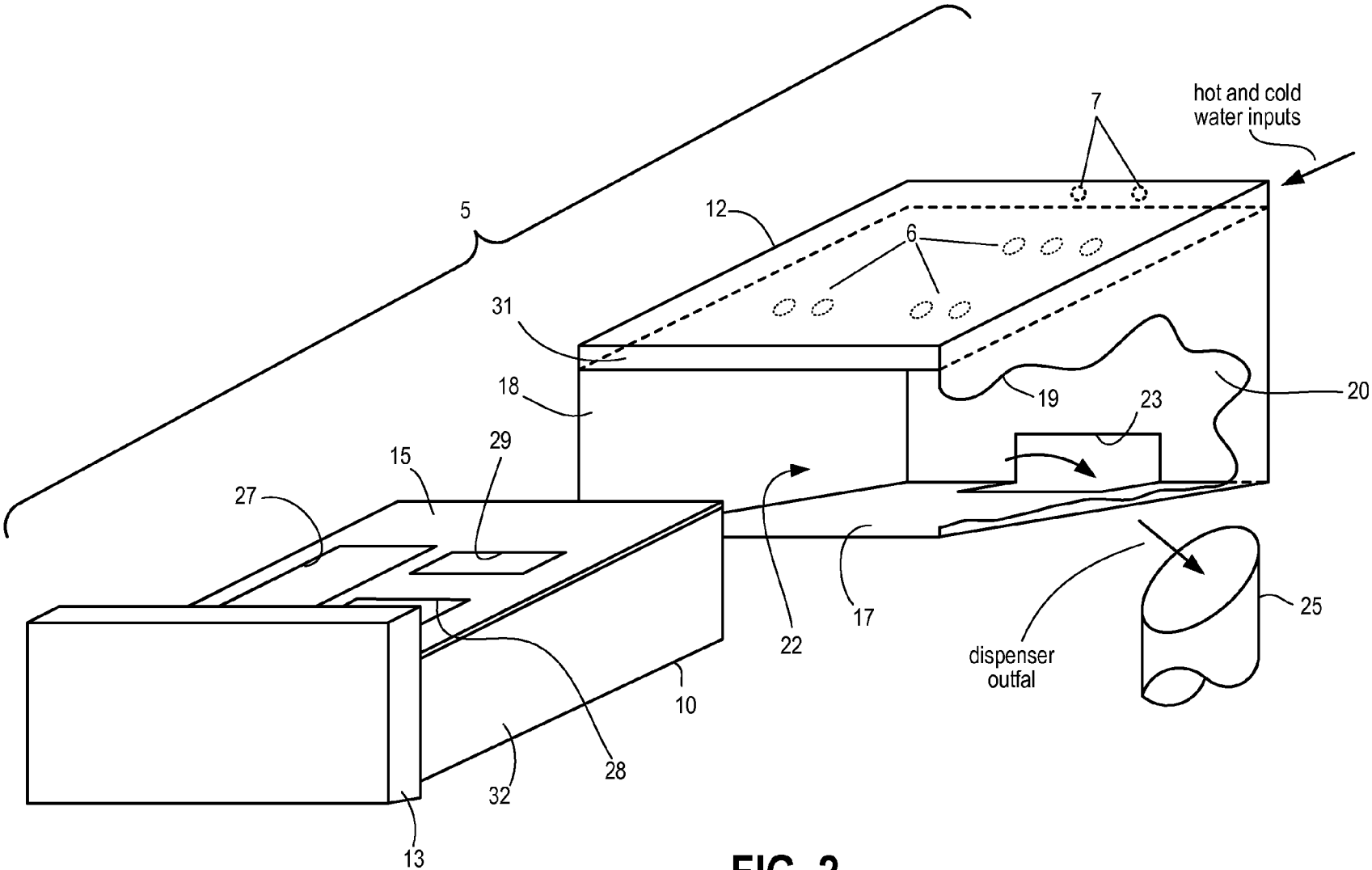
FIG. 2 is a perspective view of an additive dispenser from the washing machine of FIG. 1.

FIG. 2 illustrates dispenser 5 in further detail. Dispenser 5 includes a drawer 10 and drawer compartment 12. Drawer 10 is attached to a front panel 13 and includes a removable cover 15. Drawer compartment 12 includes a bottom 17, sides 18 and 19, and a rear 20. Side 19 is partially removed in FIG. 2 so as to show additional internal details. Drawer 10 and cover 15 slide into a cavity 22 formed by sides 18 and 19, bottom 17, and rear 20. With the exception of a drain region 23, the inner surfaces of sides 18 and 19, bottom 17 and rear 20 are fluid tight. When water is introduced into drawer 10 (as described below), water and/or additive flows from the rear of drawer 10. Because bottom 17 slopes downward, water and/or additive from drawer 10 flows into drain region 23. Drain region 23 is connected to an outfall tube 25 that carries water and/or additive to drum 3 (see FIG. 1).

Three separate chambers are formed in drawer 10. One of the chambers may hold and dispense powdered detergent, and the other two chambers may hold and dispense liquid additives (e.g., fabric softener and bleach). Openings corresponding to each of the three chambers in drawer 10 are formed in cover 15. Specifically, a first opening 27 is positioned over the chamber used to hold and dispense powdered detergent. Liquid detergent may also be dispensed from this chamber through the use of a insertable cup and cover assembly, as will be described below in conjunction with FIGS. 10-13. A second opening 28 is positioned over the chamber used to hold and dispense fabric softener, and a third opening 29 is positioned over the chamber used to hold and dispense liquid bleach.

When drawer 10 and cover 15 are fully inserted into drawer compartment 12 (as shown in FIG. 1), a water flow control assembly 31 selectively introduces water into one or more of openings 27, 28 and 29 via one or more water delivery channels (not shown). Water flow control assembly 31 is also configurable (e.g., during a rinse cycle) to bypass drawer 10 by directing water between the left side of drawer 10 (i.e., the side not visible in FIG. 2 and that is opposite to right side 32) and the inner surface of side 18 of drawer compartment 12. In some embodiments, water flow control assembly 31 includes a water conveying tray with groups of holes that are positioned over openings 27, 28 and 29 when drawer 10 and cover 15 are inserted into drawer compartment 12, as well as a group of holes located over the region between the left side of drawer 10 and the inner surface of compartment side 18. A plurality of channels are also formed in the tray so as to direct water over an appropriate group (or groups) of holes for dispensing a selected additive during a particular wash cycle. Solenoid valves are coupled to the hot and cold water inputs, and are selectively operated (either individually or in various combinations) so as to direct water through the appropriate channel(s). The water nozzles may be inserted, in one or more examples, into openings 7 of water flow control assembly 31. Various types of water flow control assemblies are known in the art. One example of a tray-type water flow control assembly having a plurality of channels and hole groupings is described in U.S. Pat. No. 6,227,012 (titled "Device for Housing Detergents and/or Other Washing Agents Which Can Be Used in a Washing Machine, Preferably in a Machine for Washing Laundry").

However, in one or more embodiments, different water control mechanisms can be used. For example, a separate tubing output could be placed in each of the locations within drawer compartment 12 that corresponds to one of openings 27, 28 and 29 and to the drawer bypass location, with a separate solenoid valve placed in a fluid flow path between each tubing output and the hot and/or cold water inputs. Further, water flow control assembly may include inflow tube outlets 6 that are configured such that outlets 6 are positioned over one or more inflow tube openings (not shown) of cover 15. The inflow tube outlets 6 may be larger in diameter than a group of holes designed to deliver water into openings 27, 28 and 29 to provide a larger and more direct flow of water into the inflow tubes. Inflow tubes are discussed in further detail below.

Figure 3:
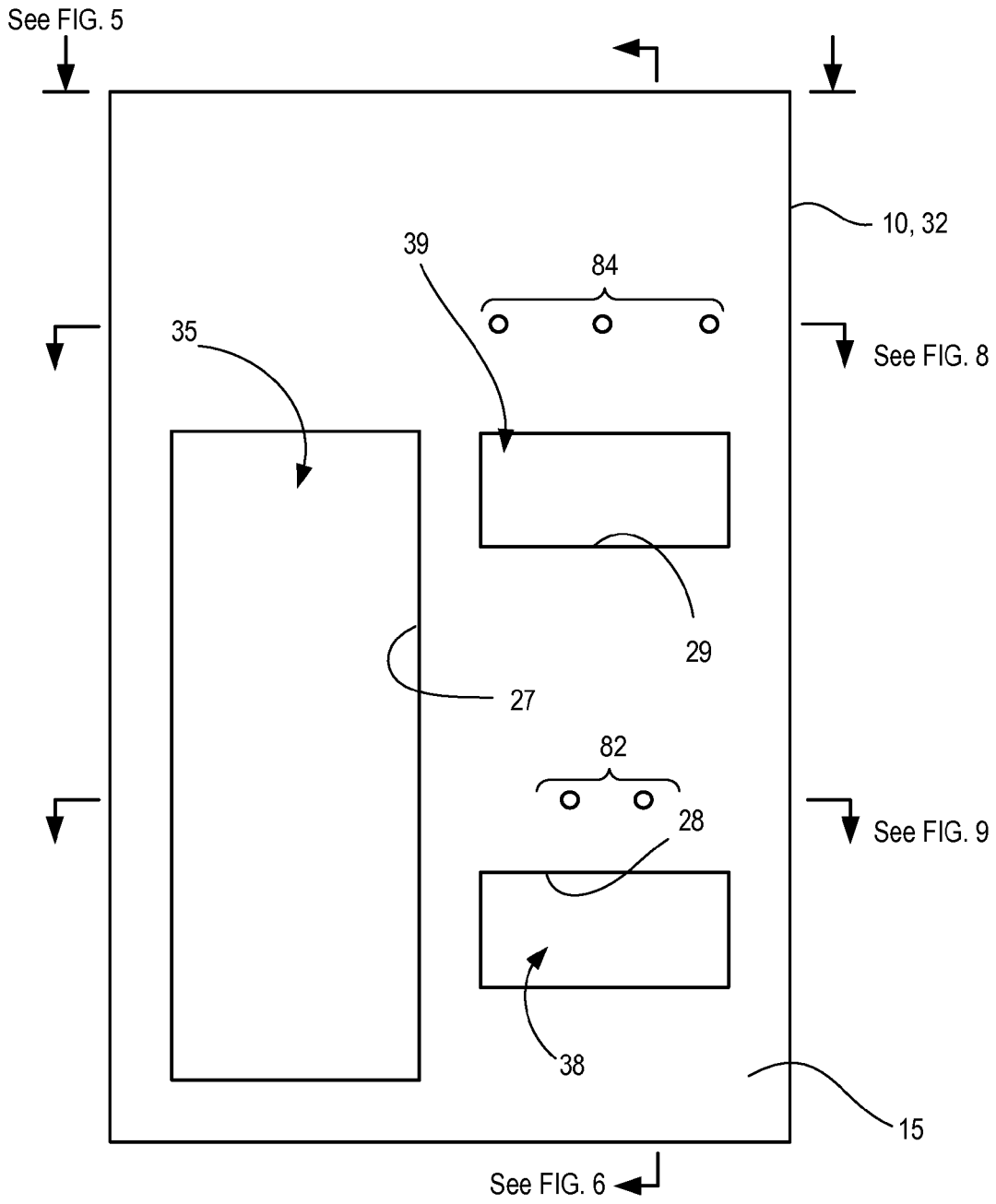
FIG. 3 is a top view of a drawer from the dispenser of FIG. 2.
Figure 4:
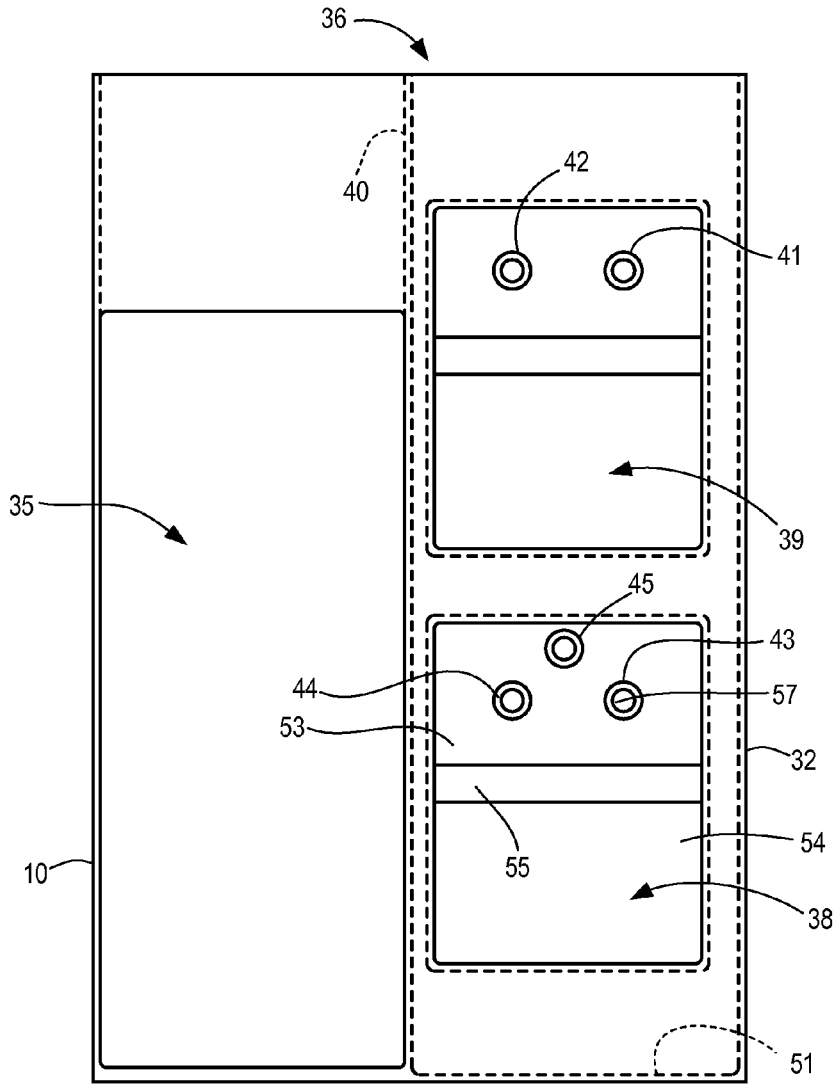
FIG. 4 is a top view of the drawer from the dispenser of FIG. 2 with the cover removed.
Figure 5:
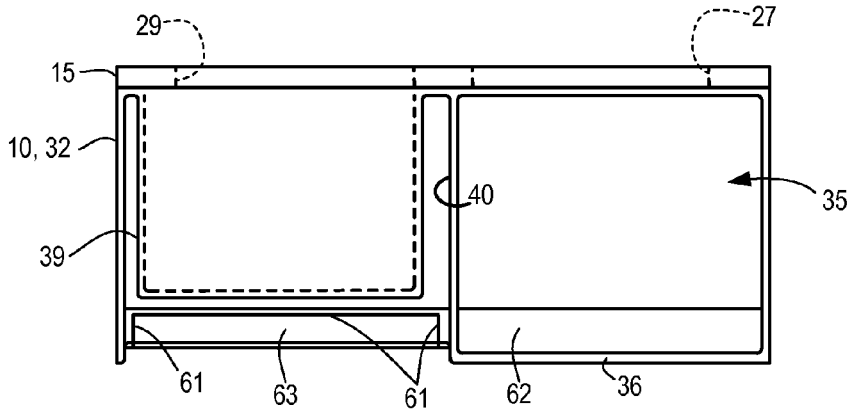
FIG. 5 is a cross-sectional view taken from the location indicated in FIG. 3.

FIG. 3 is a top view of drawer 10 with cover 15 attached. FIG. 4 is a top view of drawer 10 with cover 15 removed. For simplicity, front panel 13 is omitted from FIGS. 3 and 4, as well as from subsequent drawings. FIG. 5 is an end view of drawer 10 and cover 15 taken from the location shown in FIG. 3, and is rotated by 180° so as not to be upside down. As seen in FIG. 5, chamber 35 is open at the rear 36 of drawer 10. A removable base 63 is attached (along snap-fit lines 61) to the underside of drawer 10 under chambers 38 and 39. Such separately formed and attached pieces may be necessary or desirable from a manufacturing standpoint, e.g., to facilitate removal of the pieces from the molds of an injection molding apparatus. According to one or more aspects, base 63 might not extend all the way to rear 36 of drawer 10. Additionally, base 62 of chamber 35 may be formed as an integral part of drawer 10, and may extend all the way to rear 36.

Opening 27 in cover 15 is located over chamber 35. By introducing water into chamber 35 through opening 27, powdered detergent in chamber 35 is carried into drawer compartment 12 (see FIG. 2) and into drum 3 (FIG. 1). Openings 28 and 29 in cover 15 are located over chambers 38 and 39, respectively. Chambers 38 and 39 are generally in the shape of tanks with open tops. Fluid cannot flow out of the sides of chambers 38 and 39. Instead, and in a manner described below, fluid exits chamber 39 through siphon posts 41 and 42. As is also described below, fluid exits chamber 38 through siphon posts 43, 44 and 45. As previously indicated, in some embodiments, drawer 10 is formed from injection molded plastic. Broken lines in FIGS. 4 and 5 are used to impart a sense of thickness to the walls of chambers 35, 38 and 39, as well as to a front wall 51 of drawer 10.

Figure 6:
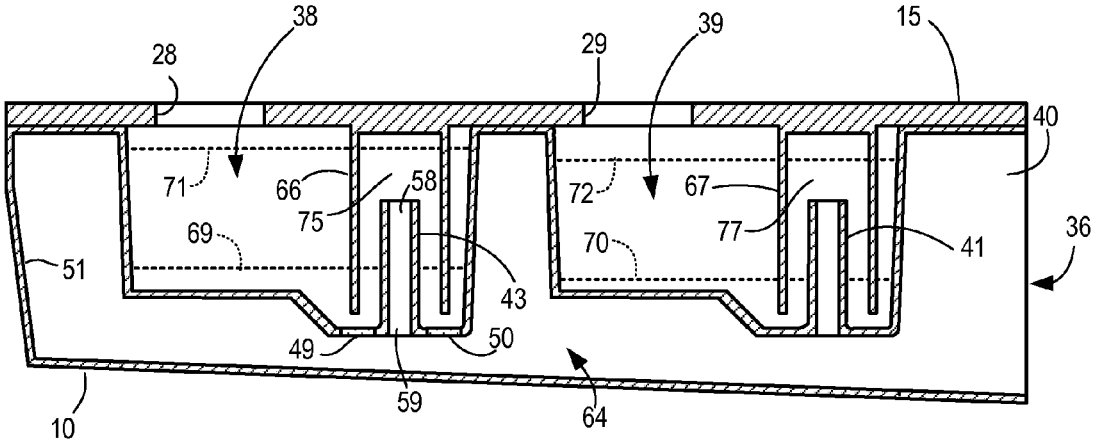
FIG. 6 is a cross-sectional view taken from the location indicated in FIG. 3.

FIG. 6 is a cross-sectional view taken from the location shown in FIG. 3, and shows drawer 10 with cover 15 in place. A cap 66 is attached to the underside of cover 15 and is positioned over siphon post 43. A cap 67 (also attached to the underside of cover 15) is positioned over siphon post 41. Additional caps (not shown) are also attached to the underside of cover 15 and similarly positioned over siphon posts 42, 44 and 45. Chambers 38 and 39 are used to hold and dispense liquid additives. In the embodiment shown, chamber 38 is used to hold and dispense relatively viscous fluid additives (e.g., fabric softener). Chamber 39 is used to hold and dispense less viscous additives (e.g., liquid bleach). In operation, a user pours liquid additives into chambers 38 and 39 through openings 28 and 29 when drawer 10 and attached cover 15 are pulled outwardly to extend from drawer compartment 12. By way of example, broken lines 69 and 70 indicate the fill levels of fabric softener (chamber 38) and bleach (chamber 39) added by a user. Actual indicia indicating a desirable fill level may be provided but are not required. Rather, the additive fill level may be any marked or unmarked fill level below the top of the siphon post, so as to avoid the siphon taking hold prior to the desired dispensing time.

After drawer 10 and attached cover 15 are pushed back into drawer compartment 12, and during appropriate times in the wash cycle, water is introduced into chamber 38 (through opening 28) and into chamber 39 (through opening 29). By way of further example, broken line 71 indicates a level of water and fabric softener mixture after water is added to chamber 38. Similarly, broken line 72 indicates a level of water and bleach mixture after water is added to chamber 39. As water is added to chamber 38 and the liquid level rises above the top of siphon post 43 (and thus above the inlet 58 of bore 57), a siphoning effect occurs within a siphon chamber 75 formed between the inner wall of cap 66 and the outer wall of siphon post 43. This siphon effect then draws liquid from chamber 38 and releases that liquid through outlet 59 of bore 57 into cavity 64, with said liquid then flowing from drawer 10 into drawer compartment 12 along bottom 63. In a similar manner, siphoning effects within siphon chambers (not shown in FIG. 6) formed about siphon posts 44 and 45 draw liquid from chamber 38 and release liquid (through outlets of bores of siphon posts 44 and 45) into cavity 64. Liquid is drawn from chamber 39 in a similar fashion through a siphon chamber 77 formed by cap 67 and siphon post 41, as well as through a siphon chamber formed by a cap located over siphon post 42 (not shown in FIG. 6).

In accordance with an aspect of the invention, a portion of the selective water delivery to the chambers of drawer 10 is carried out using water inflow tubes that deliver a flow of water to the base of one or more of the siphon assemblies included in the drawer 10. Such a feature is particularly helpful for those chambers that will hold relatively viscous additive, such as concentrated liquid laundry detergent as is becoming more and more prevalent in the marketplace. In the following discussion, although the inflow tubes are shown in association with chambers typically used to store/dispense liquid fabric softener and bleach, it will be understood that aspects of the invention are fully applicable to, and indeed may be most advantageously applied, in connection with the dispensing of viscous liquid laundry detergent.

Additionally, in one or more configurations, an additive storage chamber such as chamber 38 may further include porous elements 49 and 50 to further aid in the reduction and elimination of residual liquid and solidified residue formation, alone or in conjunction with the water inflow tubes described herein. Elements 49 and 50 may be formed from a material which allows a liquid to slowly permeate, thereby draining any liquid that remains in chamber 38 after a siphoning effect is interrupted. Because liquid does not quickly penetrate porous elements 49 and 50, however, chamber 38 is able to substantially retain the additive for deferred delivery at the appropriate time during the wash process (i.e., when water is introduced to raise the liquid level above the tops of siphon posts 43, 44 and 45, thereby permitting a siphoning effect to begin). The use of porous elements to reduce and/or eliminate residual liquid and other residue is further described in U.S. application Ser. No. 11/876,877, entitled "ADDITIVE DISPENSER", filed Oct. 23, 2007, the content of which is incorporated herein by reference in its entirety.

Figure 7:
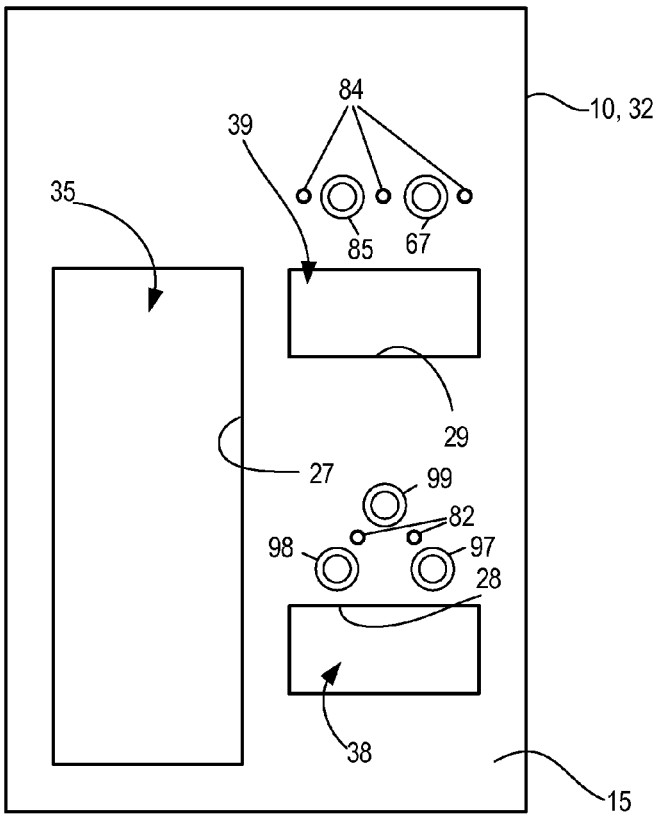
FIG. 7 illustrates a bottom view of a drawer cover according to one or more aspects described herein.

FIG. 7 illustrates a bottom view of cover 15 in further detail. In particular, cover 15 includes siphon caps 67, 85, 97, 98 and 99 and also inflow tubes 82 and 84. Water inflow tubes 82 and 84 are configured to deliver water into a bottom portion of chambers 38 and 39, respectively. That is, instead of (or in addition to) delivering water into chambers 38 and 39 from above through apertures 28 and 29, respectively, water is delivered into the chambers 38 and 39 via openings at the end of tubes 82 and 84. The length of tubes 82 and 84 may be selected such that the tubes reach a predefined distance into each of chambers 38 and 39. In one or more arrangements, the length of each of tubes 82 and 84 may be defined based on a typical or expected additive fill level in each of chambers 38 and 39. For example, each of tubes 82 and 84 may be configured such that the ends of each tube would extend downward below a top layer of an additive when the corresponding chamber is filled with the additive. Tubes 82 and 84 may extend through cover 15 allowing water or other liquids to be delivered from above cover 15 into chambers 38 and 39, respectively. Tubes 82 and 84 may extend substantially perpendicularly from cover 15. Various other configurations (e.g., shapes, sizes and orientations) of tubes may be used, as described in further detail below.

Inflow tubes 82 and 84 are further positioned within a predefined proximity of siphon cap 67 such that the inflow of water through tubes 82 and 84 may dislodge or otherwise breakup any buildup of additives at the base of a siphon post (and cap). The number of inflow tubes 82 and 84 that are included in cover 15 may vary depending factors such as viscosity, type of additive and the like. The number of inflow tubes may also differ between chambers 38 and 39. Although not illustrated, one or more inflow tubes may also be added to chamber 35. The use of cover 15 and inflow tubes 82 and 84 in conjunction with drawer 10 and chambers 38 and 39 is discussed in further detail below.

Figure 8:
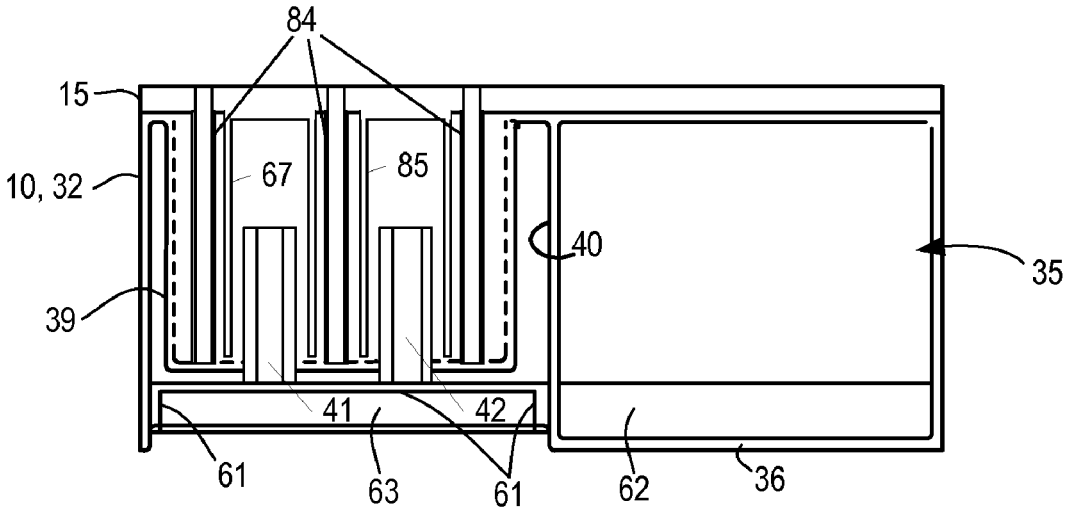
FIG. 8 is a cross-sectional view taken from the location indicated in FIG. 3

FIG. 8 is a cross-sectional view taken from the location shown in FIG. 3, and shows cover 15 in place along with water inflow tubes 84 extending into chamber 39. When attached, siphon caps 67 and 85 are positioned over siphon posts 41 and 42, respectively to form a siphon effect when a liquid is dispensed into chamber 39 and the liquid level rises above the tops of the posts 41 and 42. In addition, cover 15 includes water inflow tubes 84 that are positioned such that each of siphon posts 41 and 42 are flanked by inflow tubes 84. As discussed, the proximity of inflow tubes 84 is determined such that additive buildup at the base of either post 41 or 42 may be dislodged by a churning action of water created by inflow through tubes 82 and siphoning actions created by the siphon assemblies (e.g., post 41/cap 67 and post 41/cap 85), respectively. The siphon assemblies may be provided in various forms other than a siphon post and cap positioned thereover. In one or more arrangements, inflow tubes 84 may extend downwardly from cover 15 the same or a greater distance than siphon caps 67 and 85, to help insure that any additive buildup below the siphon cap level is flushed away.

In use, water is delivered into the dispenser drawer from above through openings 28 and 29 in cover 15 as well as through water inflow tubes 84. As water enters and collects in chamber 39, the water mixes with the additives in chamber 39. A siphoning effect will subsequently take hold once the water exceeds the height of siphon posts 41 and 42. The liquid and additive mixture is siphoned out through bores of siphon posts 41 and 42 and delivered into cavity 64 (FIG. 6). The cavity allows liquid mixtures to exit out of drawer 10 through the rear 36. Water entering from inflow tubes 84 is injected into a bottom region of chamber 39 and, in some cases, below an additive fill level of chamber 39. The use of inflow tubes 84 allows for additive residing below a surface layer to be diluted more effectively. In addition, the inflow tubes 84 can be used to prevent/remove additive buildup at the base of the siphon post/cap assemblies. In addition to presenting a tidier appearance to the user, this helps ensure reliable siphon action with repeated use over time.

Figure 9:
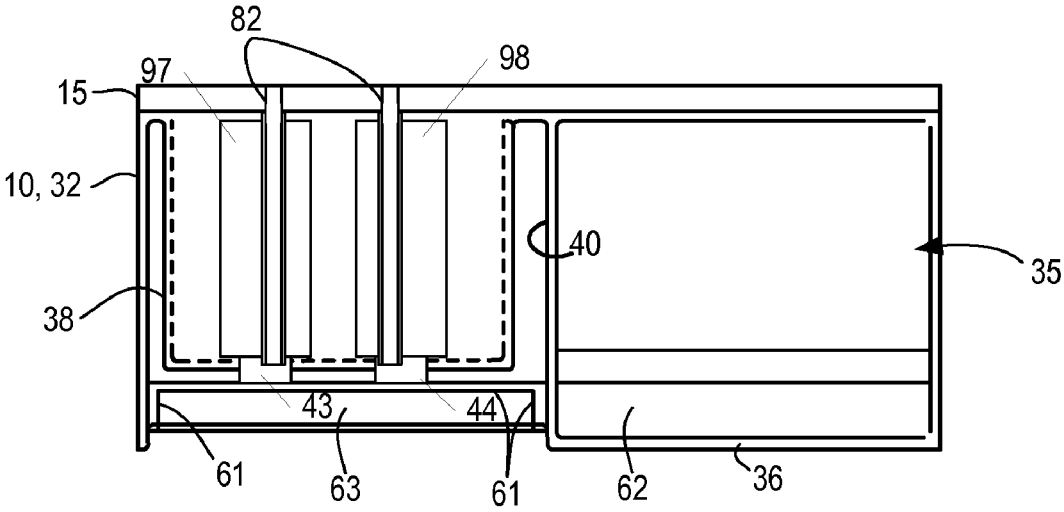
FIG. 9 is a cross-sectional view taken from the location indicated in FIG. 3.

FIG. 9 is a cross-sectional view taken from the location shown in FIG. 3, and shows cover 15 in place above chamber 38. Cover 15 includes water inflow tubes 82 that are disposed between siphon posts 43, 44 and 45 (siphon post 45 not visible in FIG. 9). Each of siphon posts 43 and 44 may further be covered by siphon caps 97 and 98, respectively. As discussed with respect to chamber 39 and FIG. 8, water may be delivered from above (e.g., from an overhead water conveyor tray) through openings 28 in cover 15 as well as through water inflow tubes 82. Delivery through both means (i.e., the cover openings 38 and the water inflow tubes 82) provides dual mixing actions that may improve the efficiency and effectiveness of additive dilution.

Water from one or more inlet nozzles may be delivered to water inflow tubes (e.g., tubes 82 and 84) through water flow control assembly 31 of FIG. 2. That is, water may be delivered by water flow control assembly through one or more outlets in the assembly. Water falling through the one or more outlets in proximity to the top openings of a water inflow tube may pass through the tube and be delivered to a region of additives residing below the additive surface. In contrast, water falling through openings in other areas of the water flow control assembly may fall directly into one or more openings such as openings 27, 28 and 29 in cover 15 and mix with an additive from above.

Figure 10:
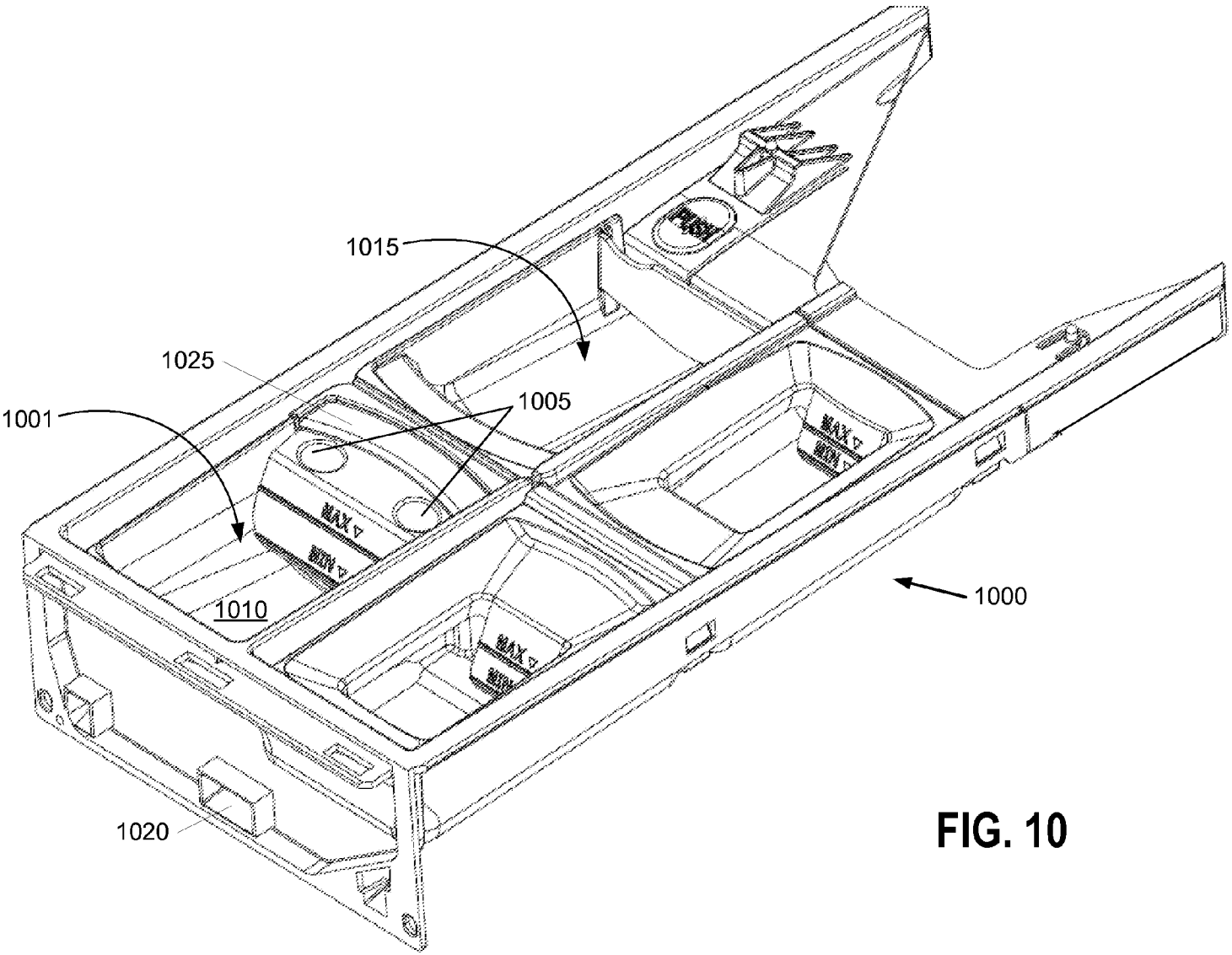
FIG. 10 is a perspective view illustrating a wash additive drawer having a removable detergent cup equipped with an inflow tube/siphon cap configuration according to one or more aspects described herein.

FIG. 10 shows more particularly an embodiment of a wash additives drawer in accordance with an aspect of the invention. The construction of the drawer generally corresponds to the more schematic depiction of FIGS. 2-7. However, in this embodiment, the water inflow tubes are not provided in the softener and the bleach compartment. Instead, they are included as part of a liquid detergent dispensing cup that removably nests within powdered detergent dispenser chamber 1015. Wash additives drawer 1000 includes multiple compartments, for example, a main compartment 1015 that may be used to store/dispense detergent. Drawer 1000 may include a front end to which a drawer front panel may be attached and a rear end equipped with a sub-floor to provide a liquid outflow into the drain region of the drawer receiving compartment (labeled 23 in FIG. 2). In order to allow deferred delivery of liquid detergent, i.e., prevent liquid detergent from flowing out of compartment 1015 prior to a desired or specified time, liquid detergent cup 1001 may be added to compartment 1015. Liquid detergent cup 1001 provides a compartment for receiving liquid detergent and is configured such that liquid detergent is not able to flow out of compartment 1015 until a level of liquid in cup 1010 exceeds a siphon post height. A siphon post/cap assembly is contained within cup 1001 underneath an enclosure structure 1025 (under which liquid is allowed to flow freely). Once liquid is dispensed into cup 1001 from above, and the liquid level exceeds the siphon post height, the contents of detergent cup 1001 may be evacuated by a siphoning action through the siphon post and into underlying compartment 1015, and exit from the cup to flow into the wash drawer.

Additionally, liquid detergent cup 1001 may further include inflow tube openings 1005 that allows water to flow directly from an overhead water conveyor below a surface of the liquid detergent (or other wash additive) and to the cup floor region in the vicinity of the base of the siphon post/cap assembly. In one or more configurations, inflow tube openings 1005 may be located in a position such that when drawer 1000 is inserted into a drawer compartment such as drawer compartment 12 of FIG. 2, tube openings 1005 are aligned with openings 6 as shown in FIG. 2 to optimize the flow and delivery of water into openings 1005 and into a sub-surface region of the wash detergent or additive.

Figure 11:
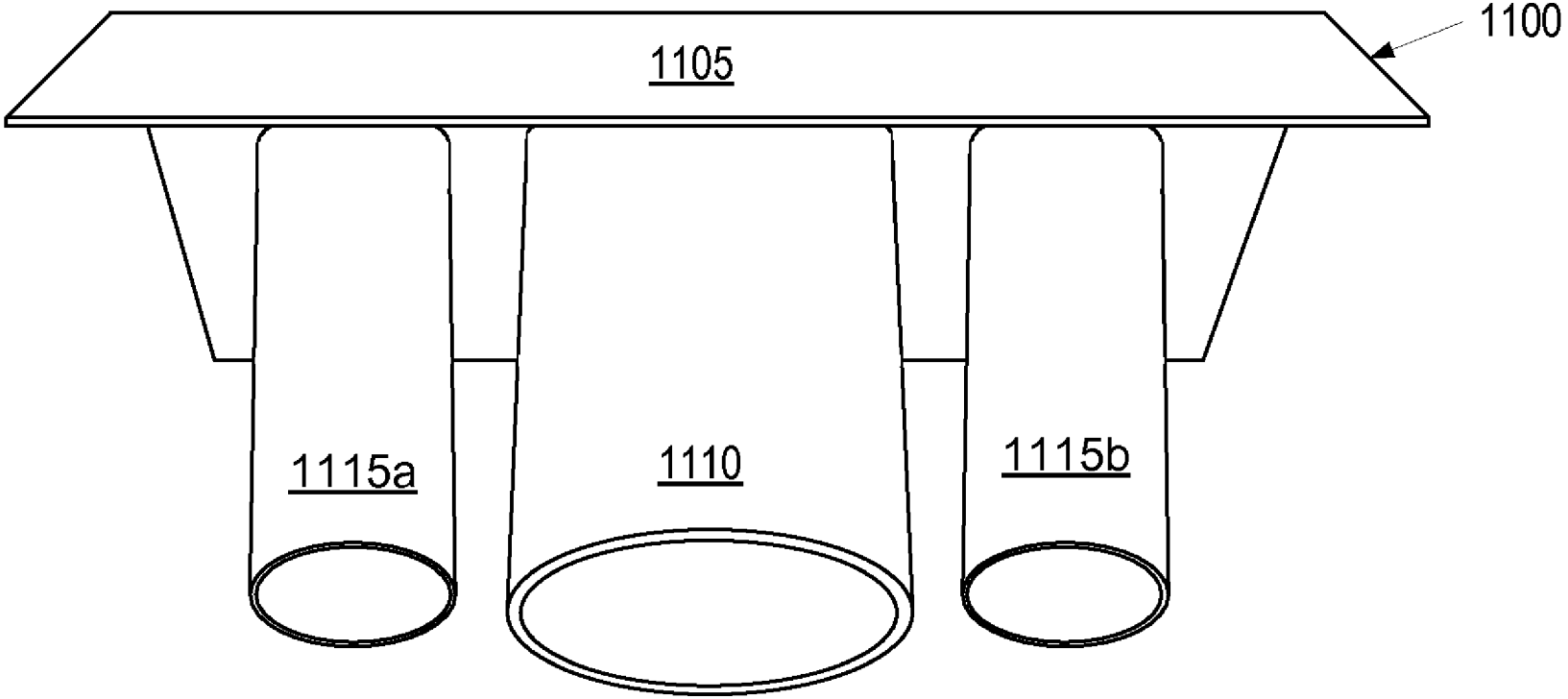
FIG. 11 is a perspective view illustrating an inflow tube/siphon cap integrally formed as part of an enclosure structure of the detergent cup of FIG. 10, according to one or more aspects described herein.
Figure 12:
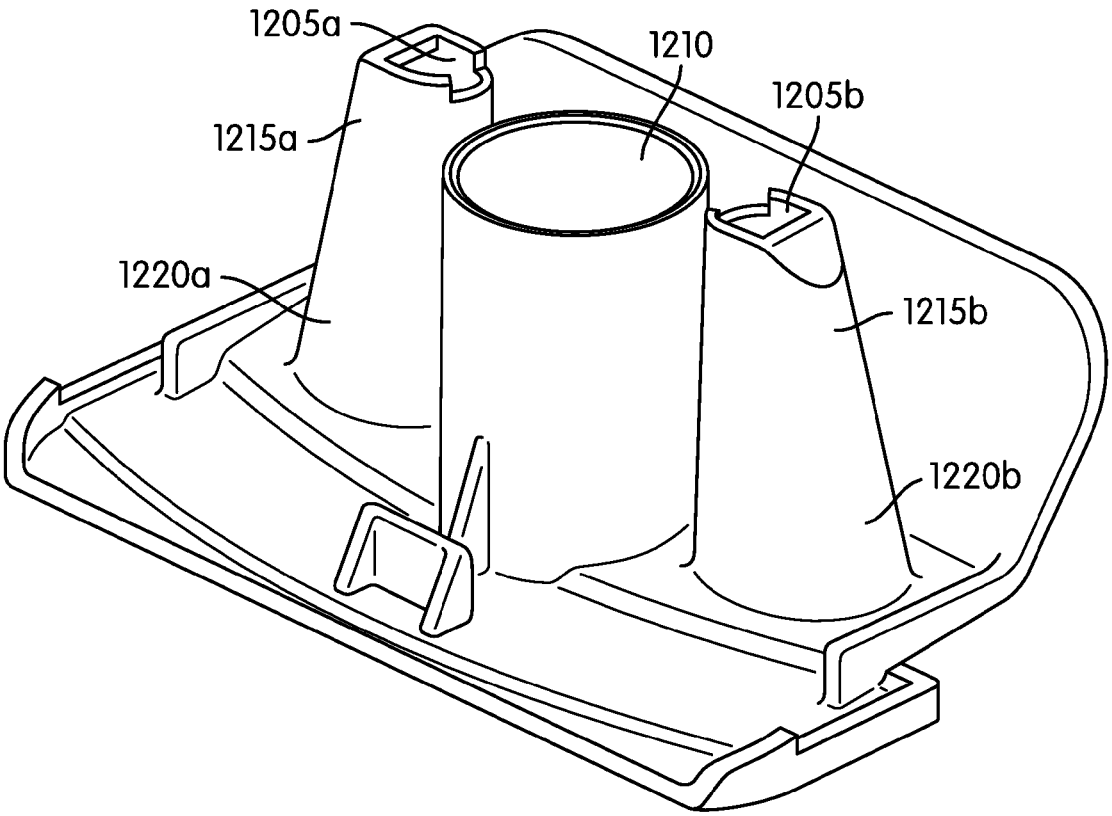
FIG. 12 is a bottom rear perspective view illustrating another embodiment of an inflow tube/siphon cap enclosure structure.
Figure 13:
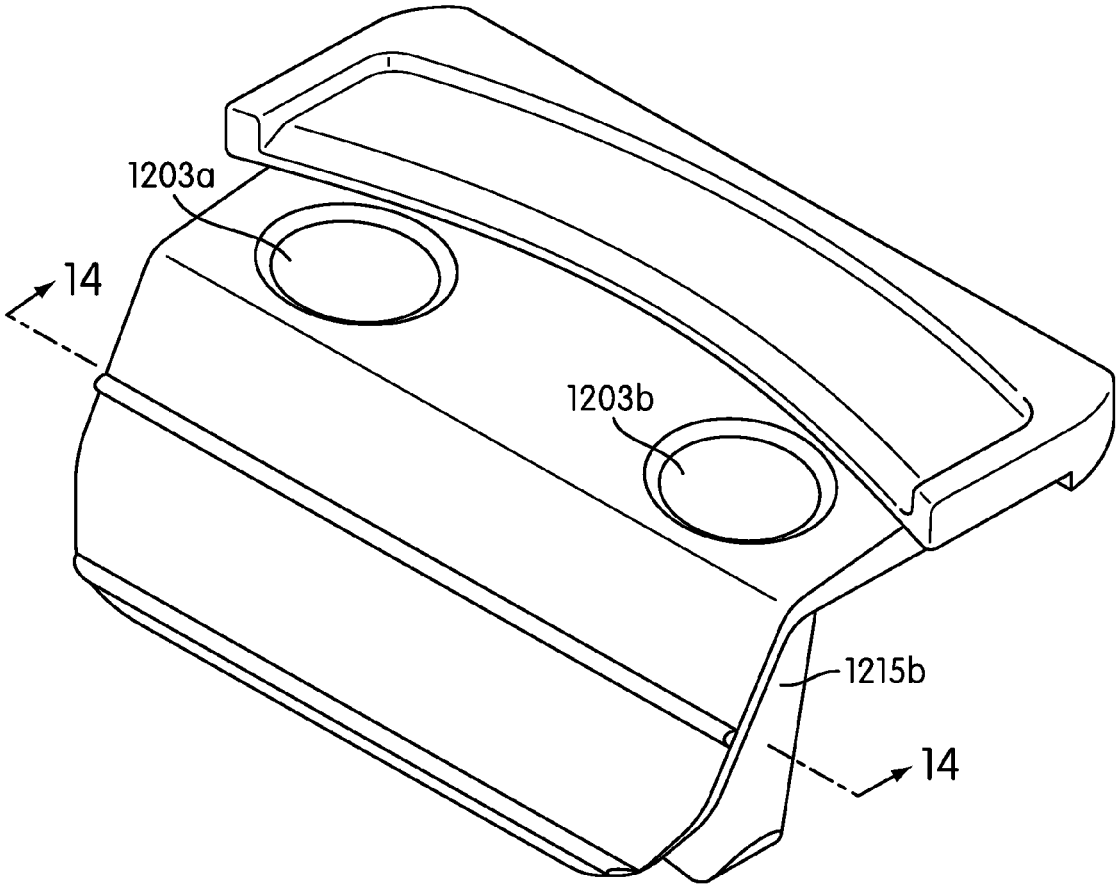
FIG. 13 is a top front perspective view of the enclosure structure of FIG. 12.
Figure 14:
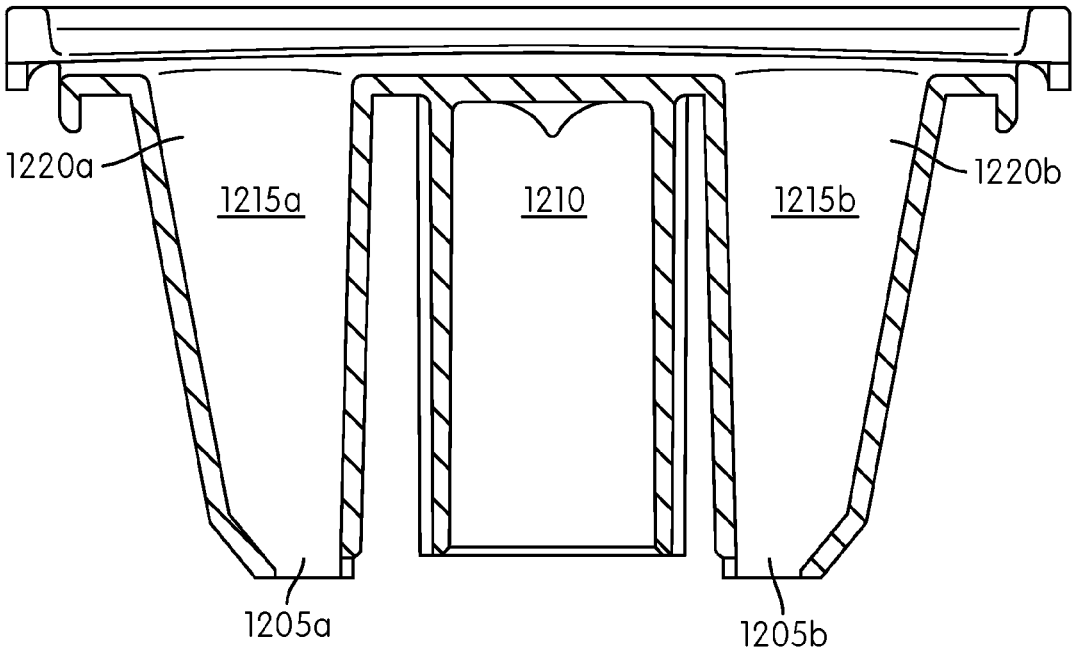
FIG. 14 is a cross-sectional view of the enclosure structure of FIG. 13 taken along the specified line.

FIG. 11 illustrates a configuration of inflow tubes and a siphon post/cap formed integrally as a part of the enclosure structure 1025 shown in FIG. 10. Structure 1100 includes a cover plate 1105 from which each of cap 1110 and tubes 1115*a, b* extend. In the illustrated configuration, tubes 1115*a, b* extend substantially parallel to cap 1110 and have a substantially equal length. Tubes 1115*a, b* may further extend downwardly a shorter distance than cap 1110. Various other embodiments may include different configurations of inflow tubes and caps. In one example, inflow tubes may be configured to provide a higher velocity inflow of water. Alternatively, inflow tubes 1115*a, b* might not be substantially parallel to cap 1110. Instead, tubes 1115*a, b* may be angled. In a further exemplary embodiment illustrated in FIGS. 12-14, the open ends 1205*a* and *b* of inflow tubes 1215*a* and *b* are angled on one side and cut-away slightly on an opposite side, so as to direct the inflow of water towards the base of the siphon post/cap assembly 1210. Additionally, inflow tubes 1215*a* and *b* are funnel-shaped in that the diameter of tubes 1215*a* and *b* decreases from water inlet openings 1203*a* and *b* adjacent upper portions 1220*a* and *b*, to open ends (outlets) 1205*a* and *b*, respectively. This shape may be used, in one or more arrangements, to increase the velocity of the water output from open ends 1205*a* and *b*.

Figure 15:
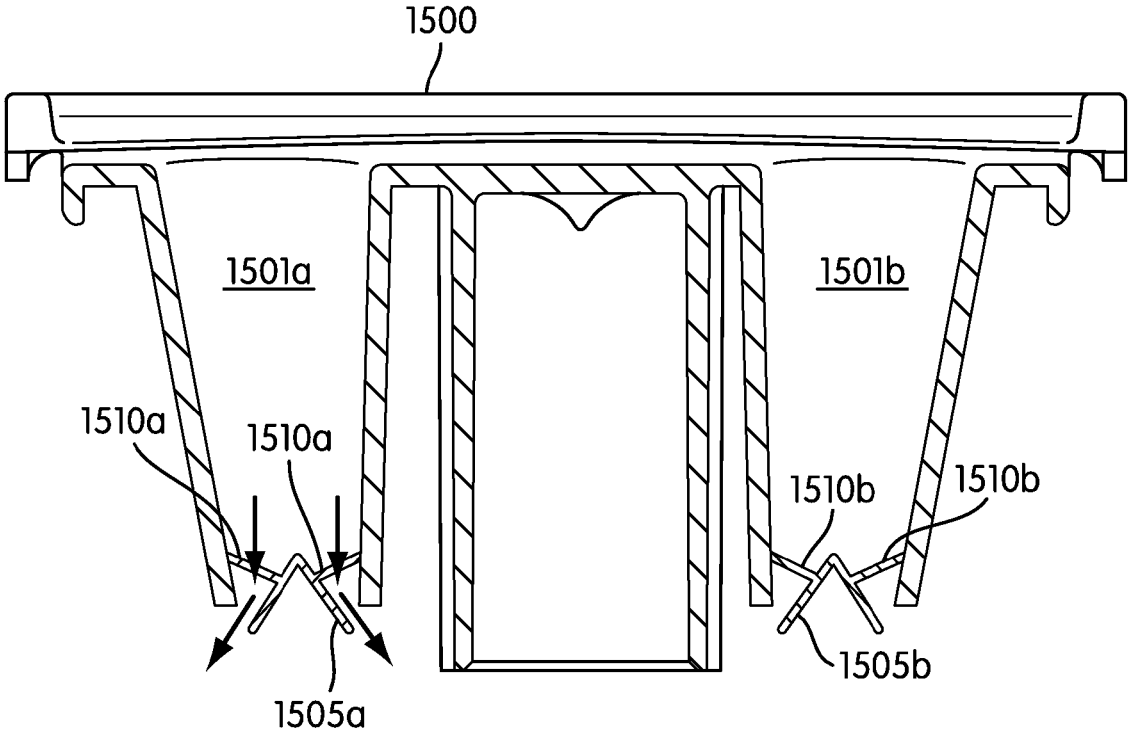
FIG. 15 is a perspective view illustrating yet another embodiment of an inflow tube/siphon cap enclosure structure.

In another embodiment illustrated in FIG. 15, inflow tube configuration 1500 may include conical members 1505*a* and *b* at the outlet ends of tubes 1501*a* and *b*, respectively. Conical members 1505*a* and *b* may be used to fan/direct water radially outwardly in a 360 degree fashion from tubes 1501*a* and *b*. Such a configuration may facilitate the distribution of water over a greater area. Conical members 1505*a* and *b* may be attached to tubes 1501*a* and *b* in a variety of ways, including through the use of narrow radially directed attachment arms 1510*a* and *b* that attach conical members 1505*a* and *b*, respectively, to interior sidewalls of tubes 1501*a* and *b*, respectively. In one example, conical member 1505*a* may be attached to tube 1501*a* using a series of four radially directed attachment arms. The shape, number and size of the attachment arms may be selected to avoid any significant blockage of water flowing through and out of tubes 1501*a* and *b*.

The invention has been described in terms of particular exemplary embodiments. Numerous other embodiments, modifications and variations within the scope and spirit of the appended claims will occur to persons of ordinary skill in the art from a review of this disclosure.

I claim:

1. An additive flow apparatus comprising:

a siphon cap configured to fit over a siphon post; and at least one water inflow tube configured to deliver water into an additive compartment, wherein the siphon cap and the at least one water inflow tube are integrally formed as a single piece, wherein, when the siphon cap is assembled with the siphon post, the at least one water inflow tube extends downwardly and substantially to a floor region of the additive compartment and, and wherein an outlet of the at least one water inflow tube is located immediately adjacent to a base of said siphon post and wherein the outlet of the at least one water inflow tube is smaller in size than an end inlet of the siphon cap, such that water exits from the outlet and reaches the base of said siphon post with the effect of dislodging material built-up around the base of said siphon post.

2. The additive flow apparatus of claim 1, further comprising a cup forming the additive compartment, wherein the additive compartment includes the siphon post and wherein the siphon cap is configured to fit over the siphon post so as to form a siphon post/cap assembly.

3. The additive flow apparatus of claim 2, wherein the outlet of the at least one water inflow tube is angled on one side and includes an angled cut-away on an opposite side relative to a longitudinal axis of the at least one water inflow tube, so as to direct the inflow of water toward the base of the siphon post/cap assembly.

4. The additive flow apparatus of claim 1, wherein the at least one water inflow tube extends substantially parallel to the siphon cap.

5. The additive flow apparatus of claim 1, wherein the at least one water inflow tube extends downwardly to or below the level of the bottom of the siphon cap.

6. The additive flow apparatus of claim 1, wherein the water inflow tube tapers along its length.

7. The additive flow apparatus of claim 1, further comprising a member positioned in said at least one water inflow tube adjacent an outlet thereof, for directing water to flow radially outwardly from said outlet.

8. The additive flow apparatus of claim 3, wherein the outlet of the at least one water inflow tube includes an angled first side and an angled cut-away on a second side facing the siphon cap.

9. The additive flow apparatus of claim 1, wherein at least one water inflow tube is cylindrically shaped.

10. The additive flow apparatus of claim 1, wherein a floor of the additive compartment includes a recessed region below the at least one water inflow tube and the siphon cap, wherein the siphon post extends upwardly from the recessed region.

11. An additive flow apparatus comprising:

a siphon cap configured to fit over a siphon post; and at least one water inflow tube configured to deliver water into an additive compartment, wherein the siphon cap and the at least one water inflow tube are integrally formed as a single piece, wherein, when the siphon cap is assembled with the siphon post, the at least one water inflow tube extends downwardly and substantially to a floor region of the additive compartment, wherein a floor of the additive compartment includes a recessed floor surface below the at least one water inflow tube and the siphon cap, wherein the siphon post extends upwardly from the recessed floor surface, and wherein the at least one water inflow tube extends below a non-recessed floor surface of the additive compartment floor without contacting the additive compartment floor.

12. The additive flow apparatus of claim 11, wherein the additive compartment floor further includes a sloped region connecting the recessed floor surface to the non-recessed floor surface.

13. An additive flow apparatus comprising:

a siphon cap configured to fit over a siphon post; and first and second water inflow tubes configured to deliver water into an additive compartment, wherein the siphon cap and the first and second water inflow tubes are integrally formed as a single piece, wherein, when the siphon cap is assembled with the siphon post, the first and second water inflow tubes extend downwardly and substantially to a floor region of the additive compartment and an outlet of each of the first and second water inflow tubes is located adjacent to a base of said siphon post such that water exits from the outlet and reaches the base of said siphon post with the effect of dislodging material built-up around the base of said siphon post, and wherein the first water inflow tube is positioned on a first side of the siphon cap and the second water inflow tube is positioned on a second side of the siphon cap.

14. The additive flow apparatus of claim 13, wherein a floor of the additive compartment includes a recessed region below the first and second water inflow tubes and the siphon cap, wherein the siphon post extends from the recessed region.

* * * * *